US009443680B2

(12) United States Patent
Hu

(10) Patent No.: US 9,443,680 B2
(45) Date of Patent: Sep. 13, 2016

(54) ELECTRONIC DEVICE AND INPUT DEVICE THEREOF

(71) Applicants: AMBIT MICROSYSTEMS (SHANGHAI) LTD., Shanghai (CN); HON HAI PRECISION INDUSTRY CO., LTD., New Taipei (TW)

(72) Inventor: Wang-An Hu, Shanghai (CN)

(73) Assignees: AMBIT MICROSYSTEMS (SHANGHAI) LTD., Shanghai (CN); HON HAI PRECISION INDUSTRY CO., LTD., New Taipei (TW)

( * ) Notice: Subject to any disclaimer, the term of this patent is extended or adjusted under 35 U.S.C. 154(b) by 156 days.

(21) Appl. No.: 14/252,533

(22) Filed: Apr. 14, 2014

(65) Prior Publication Data

US 2015/0107969 A1 Apr. 23, 2015

(30) Foreign Application Priority Data

Oct. 18, 2013 (CN) ..... 2013 1 0487998

(51) Int. Cl.
*H01H 9/00* (2006.01)
*H01H 25/06* (2006.01)

(52) U.S. Cl.
CPC ..... *H01H 25/06* (2013.01); *H01H 2221/01* (2013.01); *H01H 2221/03* (2013.01); *H01H 2225/028* (2013.01)

(58) Field of Classification Search
CPC ..... H01H 19/00; H01H 19/58; H01H 3/00; H01H 3/02; H01H 3/08; H01H 3/12; H01H 13/00; H01H 13/503; H01H 13/52; H01H 15/00; H01H 2221/01; H01H 1/00; H01H 3/10; H01H 3/0253; H01H 13/14; H01H 13/26; H01H 13/50; H01H 13/64; H01H 13/66; H01H 19/14; H01H 2003/12; H01H 2013/00; H01H 3/20; H01H 13/02; H01H 13/705; H01H 13/70; H01H 43/04; H01H 9/18; H01H 25/00; H01H 2221/012
USPC ..... 200/11 TW, 5 R, 5 A, 177, 11 DA, 329, 200/341, 345, 6 A, 11, 18, 4, 11 R; 341/20, 341/21
See application file for complete search history.

(56) References Cited

U.S. PATENT DOCUMENTS

2008/0130866 A1 6/2008 Looi
2010/0193340 A1* 8/2010 Ujimoto ..... B60N 2/0228 200/339

FOREIGN PATENT DOCUMENTS

CN 201167044 Y 12/2008
CN 101694821 A 4/2010
CN 201438428 U 4/2010

(Continued)

*Primary Examiner* — Renee S Luebke
*Assistant Examiner* — Anthony R. Jimenez
(74) *Attorney, Agent, or Firm* — Zhigang Ma

(57) ABSTRACT

Input device includes a printed circuit board, a first switch, a button and at least one second switch. The first switch is arranged at the printed circuit board, and is electrically connected to the printed circuit board. The at least one second switches are arranged at the printed circuit board surrounding the first switch. The guide body is arranged on the printed circuit board. The button is arranged on the guide body. The button is configured to move towards the circuit board to trigger the first switch. The button is also configured to rotate with respect to the circuit board to trigger the second switch.

20 Claims, 5 Drawing Sheets

(56) References Cited

FOREIGN PATENT DOCUMENTS

| | | | |
|---|---|---|---|
| CN | 201584344 | U | 9/2010 |
| CN | 200910301391.X | | 10/2010 |
| JP | 2001118469 | | 4/2001 |
| TW | I295768 | | 4/2008 |
| TW | 200849301 | A | 12/2008 |
| TW | 201330040 | A1 | 7/2013 |

* cited by examiner

ELECTRONIC DEVICE AND INPUT DEVICE THEREOF

FIELD

The present disclosure relates to electronic devices, and more particularly to an input device.

BACKGROUND

An input device is usually applied to portable products to trigger corresponding functions. Nowadays, portable products supplied with various functions. A conventional input device may include a number of buttons or keys, one key or button can be operated to call only one function, which results in a plurality of buttons or keys needed as the input device.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
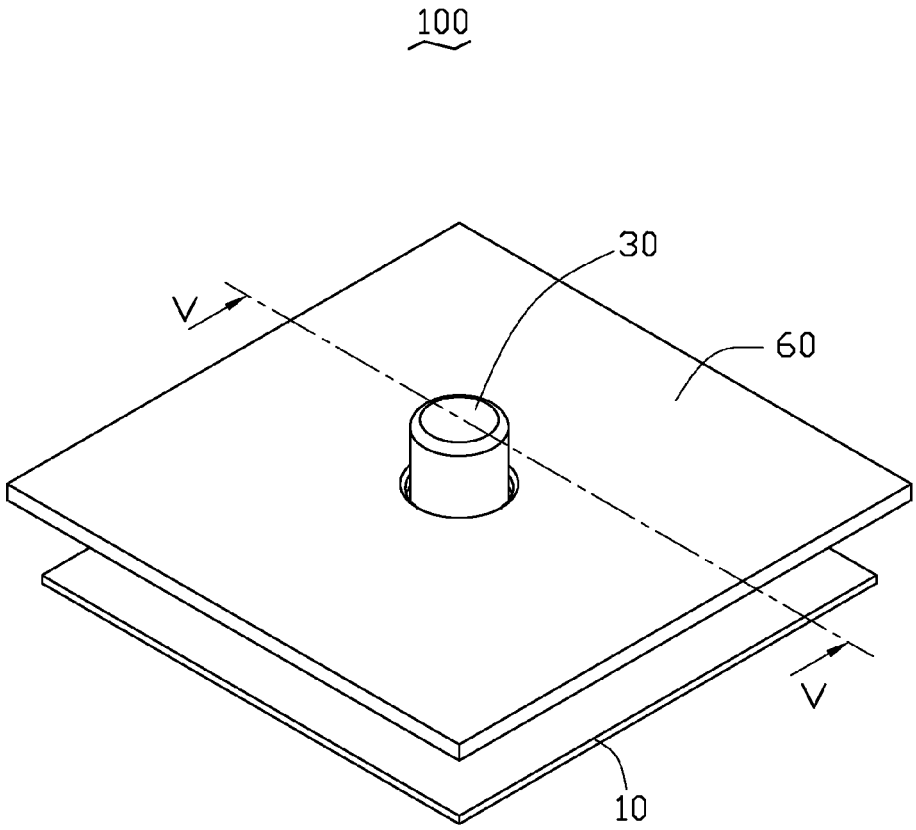
FIG. 1 is an isometric view of an input device in accordance with an embodiment of the present disclosure.

The disclosure is illustrated by way of example and not by way of limitation in the figures of the accompanying drawings in which like reference numerals indicate the same or similar elements. It should be noted that references to "an" or "one" embodiment in this disclosure are not necessarily to the same embodiment, and such references can mean "at least one."

Figure 2:
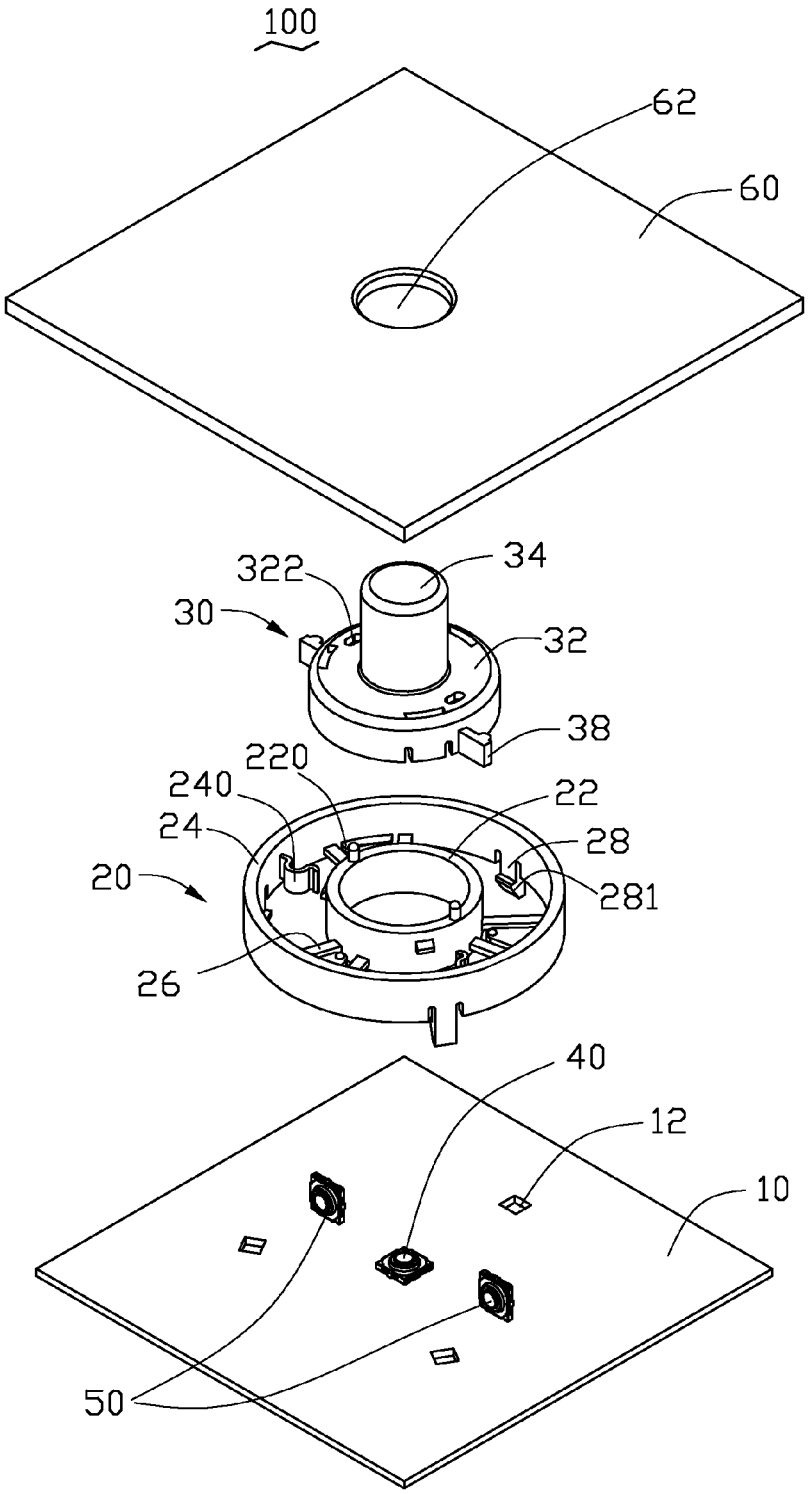
FIG. 2 is an exploded, isometric view of the input device in FIG. 1.
Figure 3:
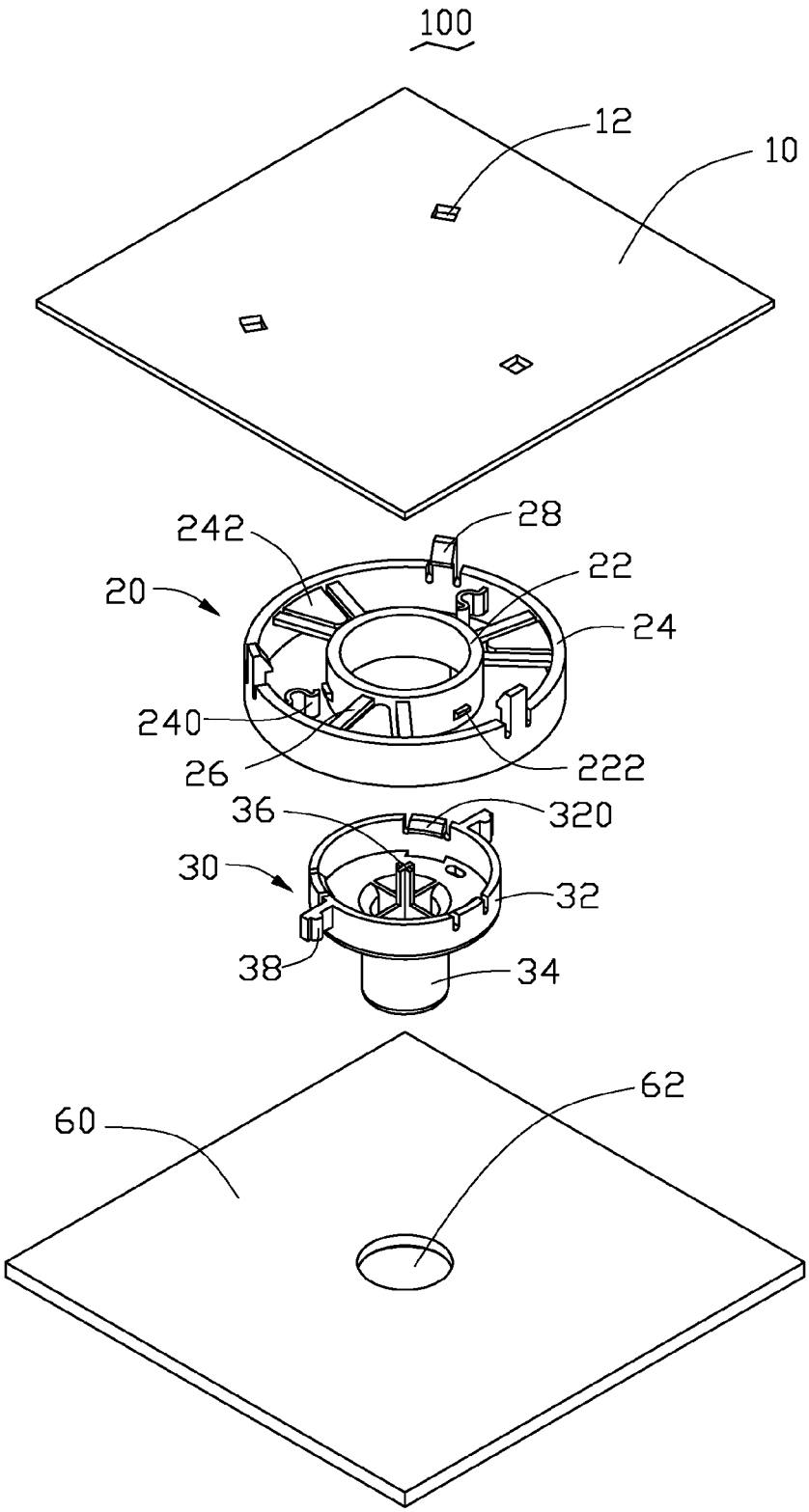
FIG. 3 is an inverted view of the input device in FIG. 2.

The FIGS. 1, 2 and 3 illustrate an input device 100 of the embodiment. The input device 100 includes a printed circuit board 10, a first switch 40 electrically connected with the printed circuit board 10. A guide body 20, a button 30, a second switch 50, and a cover 60, can be arranged on the printed circuit board 10.

In the embodiment, the first switch 40 is a reed switch, and the second switch 50 is a micro switch. The first switch 40 and the second switch 50 are arranged on the printed circuit board 10 and are electronically connected with a conductive pattern formed on the printed circuit board 10.

The guide body 20 includes a first mounting portion 22 and a second mounting portion 24 and a plurality of joint arms 26. The first mounting portion 22 is arranged inside of the second mounting portion 24, and surrounded by the second mounting portion 24, and the plurality of the joint arms 26 is connected between the first mounting portion 22 and the second mounting portion 24.

FIG. 3 illustrates that a plurality of positioning protrusions 28 protrudes downwardly from a bottom portion of the second mounting portion 24 at intervals. Each free end of the plurality of the positioning protrusions 28 is provided with a pin portion 281 protruding inwardly. A plurality of first elastic pieces 242 are extended from an inner wall of the second mounting portion 24 towards the first mounting portion 22. The first elastic piece 242 is capable of being deformed at intervals. A plurality of second elastic pieces 240 are extended from an inner wall of the second mounting portion 24 towards the first mounting portion 22 in intervals, the second elastic pieces 242 are capable of being deformed. In the embodiment, the second mounting portion 24 includes three first elastic pieces 242 and two second elastic pieces 240.

A plurality of stopper protrusions 220 extend from a top of the first mounting portion 22 in intervals. A plurality of pins 222 extend from a periphery of the first mounting portion 22 towards second mounting portion 24 in intervals. In the embodiment, the first mounting portion 22 includes two stopper protrusions 220 and three pins 222.

The printed circuit board 10 defines a plurality of coupling holes 12 corresponding to the coupling protrusions 28. In assembly, each of the positioning protrusions 28 is inserted into the corresponding coupling hole 12 with the pin portion 281 retained to the bottom of the circuit board 10, such that the guide body 20 is fixed onto the printed circuit board 10.

The button 30 includes a hollow columnar main body 32, and a columnar operation portion 34 protruding upwardly from a top portion of the main body 32. The operation portion 34 is arranged at a center of the top portion of the main body 32. A first push protrusion 36 protrudes downwardly from a bottom portion of the main body 32. At least one second push protrusion 38 protrudes from an outside surface of the main body 32. A diameter of the operation portion 34 is smaller than a diameter of the main body 32, which allows users to operate the operation portion 34 easily.

A plurality of hooks 320 is located at the bottom of main body 32 opposite to the operation portion 34. The hooks 320 respectively correspond to the plurality of the pins 222. When the button 30 is mounted on the guide body 20, the hooks 320 are respectively retained to the pins 222 to fix the button 30 to the guide body 20. The main body 32 is mounted on and surrounds the first mounting portion 22. A plurality of guide slots 322 is defined in main body 32 corresponding to the plurality of the stopper protrusions 220 of the first mounting portion 22. Therefore, when the button 30 is rotated in the guide body 20 while being mounted on the first mounting portion 22, the stopper protrusion 220 is received in the guide slot 322. At the same time, the stopper protrusion 220 slides along the guide slot 322 and regulates a rotation of the button 30.

Figure 4:
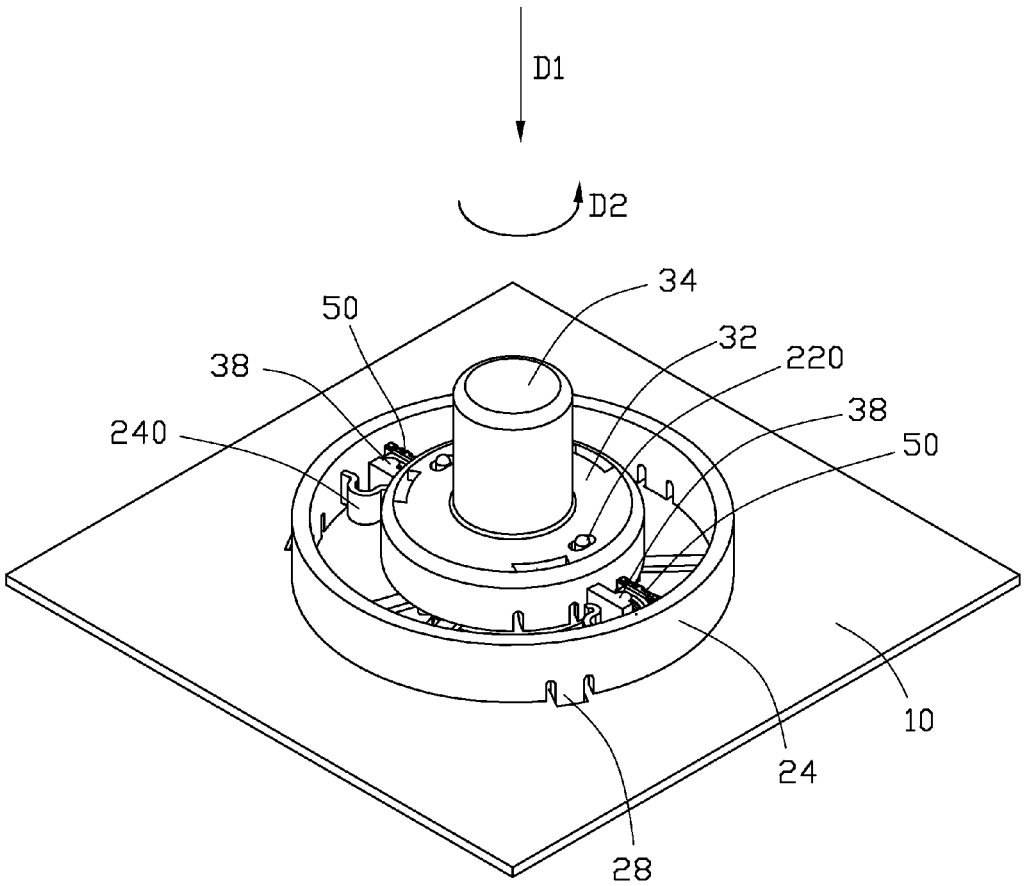
FIG. 4 is an assembled view of the input device in FIG. 1 without a cover.
Figure 5:
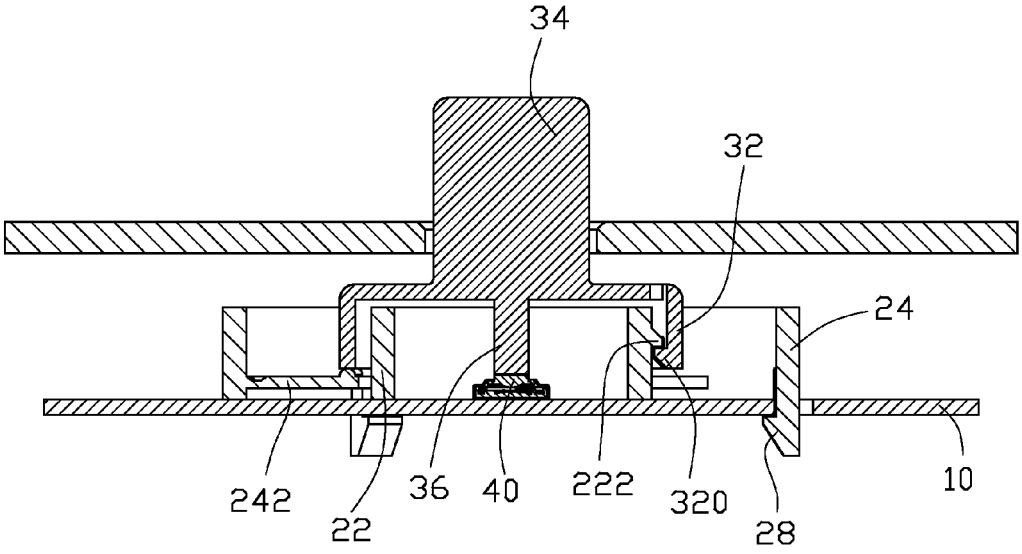
FIG. 5 is a cross-section view taken along line V-V of FIG. 1.

FIG. 4 and FIG. 5 illustrate that in assembly, the button 30 is mounted to the guide body 20 with the first push protrusion 36 passing through the first mounting portion 22 and contacting the first switch 40. In addition, the bottom of the main body 32 is supported on the first elastic piece 242. When the button 30 is pushed in a first direction D1, the first elastic piece 242 is forced to deform by the button 30 to generate a first elastic force. When the button 30 is released, the button 30 is pushed upwardly by the first elastic force. The second push protrusions 38 are arranged between the second elastic piece 240 and the second switch 50. When the button 30 is rotated along the second direction D2, the second elastic piece 240 is forced to deform by the second push protrusion 28 to generate a second elastic force. And when the button 30 is released, the button 30 is driven to its original state by the second elastic force. In the embodiment, the first direction D1 is perpendicular to the second direction D2, and a plane defined by the second direction D2 is parallel to the printed circuit board 10.

In the embodiment, there are two second switches 50 respectively corresponding to the two second push protrusions 38, when the button 30 is pushed, the first push protrusion 36 pushes the first switch 40 to trigger a default function of the first switch 40, such as: turning off, turning on or some other actions, when the button 30 is rotated clockwise, the one of the two second push protrusions 38 pushes the one of the two second switches 50 to trigger a default function of the second switch 50, such as turning off, turning on or some other actions. When the button 30 is rotated counter clockwise, the other one of the two second push protrusions 38 pushes the other one of the two second switches 50 to trigger a default function of the second switch 50, such as turning off, turning on or some other action.

The cover 60 includes an opening 62 in a center, the cover 60 is arranged on the main body 32 of button 30 with the operation portion 34 passing through the opening 62. In the embodiment, the cover 60 is plate-shaped Comparing to prior art, the input device 100 of the present disclosure can trigger the first switch 40 via upward and downward movement of the button 30, but also can trigger the second switch 50 via rotation movement of the button 30.

Although various features and elements are described as embodiments in particular combinations, each feature or element can be used alone or in other various combinations within the principles of the present disclosure to the full extent indicated by the broad general meaning of the terms in which the appended claims are expressed.

What is claimed is:

1. An input device comprising:

a printed circuit board;

a first switch electrically coupled with the printed circuit board;

a guide body arranged at the printed circuit board, comprising a second mounting portion;

a button arranged on the guide body, at least one second push protrusions protruding outwardly from a periphery of the button, and a plurality of second elastic pieces extending from an inner wall of the second mounting portion towards a central direction of the second mounting portion; and at least one second switches electrically coupled with the printed circuit board, and the at least one second push protrusions arranged between the plurality of second elastic pieces and the at least one second switches;

wherein the button is configured to move towards the circuit board in a first direction to trigger the first switch; and the button is also configured to rotate with respect to the circuit board in a second direction to trigger the second switch; and wherein when the button is rotated along the second direction, the plurality of second elastic pieces are resisted to deform by the at least one second push protrusions to generate an elastic force, and when the button is released, the button is driven to its original state by the elastic force.

2. The input device of the claim 1, wherein the button comprises a main body, an operation portion protruding upwardly from the main body, a first push protrusion protruding downwardly from the main body, the at least one second push protrusion protruding outwardly from a periphery of the main body, the first push protrusion is used for pushing the first switch, and the at least one second push protrusion is used for pushing the at least one second switches.

3. The input device of the claim 2, wherein the guide body comprises a first mounting portion arranged in a center portion of the second mounting portion, a plurality of joint arms coupling the first mounting portion and the second mounting portion, and a plurality of positioning protrusions protruding downwardly from a bottom of the second mounting portion.

4. The input device of the claim 3, wherein free ends of the positioning protrusions are respectively inserted in corresponding coupling holes and coupled to a bottom of the printed circuit board.

5. The input device of the claim 3, wherein the main body of the button is mounted on the first mounting portion with the first push protrusion passing through the first mounting portion to push the first switch.

6. The input device of the claim 5, wherein a plurality of stopper protrusions upwardly extend from a top of the first mounting portion, a plurality of guide slots is defined in the main body of the button respectively corresponding to the plurality of the stopper protrusions, when the button is rotated in the guide body while the button is mounted on the first mounting portion with the stopper protrusion received in the guide slot, the stopper protrusion slides along a guide slot and regulate a rotation amount of the button.

7. The input device of the claim 5, wherein a plurality of pins extend from a periphery of the first mounting portion towards second mounting portion, a plurality of hooks are arranged on the main body of the button respectively corresponding to the plurality of pins, the plurality of hooks are retained to the plurality of pins to mount the button and the guide body.

8. The input device of the claim 5, wherein a plurality of first elastic pieces extend from an inner wall of the second mounting portion towards the first mounting portion, a first elastic piece is capable of being deformed, the bottom of the main body is supported on the first elastic piece, when the button is pushed downwardly, the first elastic piece is forced to deform elastically by the button, when the button is released, the button is pushed upwardly by the first elastic piece.

9. The input device of the claim 5, wherein the plurality of second elastic pieces are extended from an inner wall of the second mounting portion towards the first mounting portion, the second elastic piece is capable of being deformed, when the button is rotated, a movement away from the second switch is defined by the second elastic piece.

10. The input device of the claim 1, wherein the at least one second switches comprises two second switches, correspondingly, the at least one second push protrusions comprises two second push protrusion, when the button is rotated in a clockwise direction, one of the two second push protrusion triggers the one of the two second switches to trigger a default function of the second switch, when the button is rotated in an anticlockwise direction, the other one of the two second push protrusions triggers the other one of the two second switches to trigger a default function of the second switch.

11. An electronic device comprising:

a housing; and a input device received in the housing, the input device comprising:

a printed circuit board;

a first switch electrically coupled with the printed circuit board;

a guide body arranged at the printed circuit board, comprising a second mounting portion;

a button arranged on the guide body, at least one second push protrusions protruding outwardly from a periphery of the button, and a plurality of second elastic pieces extending from an inner wall of the second mounting portion towards a central direction of the second mounting portion; and at least one second switches electrically coupled with the printed circuit board, and the at least one second push protrusions arranged between the plurality of second elastic pieces and the at least one second switches;

wherein the button is configured to move towards the circuit board in a first direction to trigger the first switch; and the button is also configured to rotate with respect to the circuit board in a second direction to trigger the second switch; and wherein when the button is rotated along the second direction, the plurality of second elastic pieces are resisted to deform by the at least one second push protrusions to generate an elastic force, and when the button is released, the button is driven to its original state by the elastic force.

12. The input device of the claim 11, wherein the button comprises a main body, an operation portion protruding upwardly from the main body, a first push protrusion protruding downwardly from the main body, at least one second push protrusion protruding outwardly from a periphery of the main body, the first push protrusion is used for pushing the first switch, and the at least one second push protrusion is used for pushing the at least one second switches.

13. The input device of the claim 12, wherein the guide body comprises a first mounting portion arranged in a center portion of the second mounting portion, a plurality of joint arms coupling the first mounting portion and the second mounting portion, and a plurality of positioning protrusions protruding downwardly from a bottom of the second mounting portion.

14. The input device of the claim 13, wherein free ends of the positioning protrusions are respectively inserted in corresponding coupling holes and coupled to a bottom of the printed circuit board.

15. The input device of the claim 13, wherein the main body of the button is mounted on the first mounting portion with the first push protrusion passing through the first mounting portion to push the first switch.

16. The input device of the claim 15, wherein a plurality of stopper protrusions upwardly extend from a top of the first mounting portion, a plurality of guide slots is defined in the main body of the button respectively corresponding to the plurality of the stopper protrusions, when the button is rotated in the guide body while the button is mounted on the first mounting portion with the stopper protrusion received in the guide slot, the stopper protrusion slides along a guide slot and regulates a rotation amount of the button.

17. The input device of the claim 15, wherein a plurality of first elastic pieces extend from an inner wall of the second mounting portion towards the first mounting portion, a first elastic piece is capable of being deformed, the bottom of the main body is supported on the first elastic piece, when the button is pushed downwardly, the first elastic piece is forced to deform elastically by the button, when the button is released, the button is pushed upwardly by the first elastic piece.

18. The input device of the claim 15, wherein the plurality of second elastic pieces extend from an inner wall of the second mounting portion towards the first mounting portion, the second elastic piece is capable of being deformed when the button is rotated, a movement away from the second switch is defined by the second elastic piece.

19. An input device comprising:

a printed circuit board;

a first switch electrically coupled with the printed circuit board;

a guide body arranged at the printed circuit board, comprising a second mounting portion;

a button arranged on the guide body, at least one second push protrusions protruding outwardly from a periphery of the button, and a plurality of second elastic pieces extending from an inner wall of the second mounting portion towards a central direction of the second mounting portion; and at least one second switches electrically coupled with the printed circuit board, and the at least one second push protrusions arranged between the plurality of second elastic pieces and the at least one second switches;

wherein the button is configured to move in a first direction to trigger the first switch;

and the button is also configured to move in a second direction to trigger the second switch; and wherein when the button is rotated along the second direction, the plurality of second elastic pieces are resisted to deform by the at least one second push protrusions to generate an elastic force, and when the button is released, the button is driven to its original state by the elastic force.

20. The input device of the claim 19, wherein the first direction is perpendicular to the second direction.

* * * * *